United States Patent [19]

Klokkers

[11] 4,190,873

[45] Feb. 26, 1980

[54] PROTECTIVE DEVICE FOR AN ELECTRON TUBE

[75] Inventor: Frits H. Klokkers, Almelo, Netherlands

[73] Assignee: U.S. Philips Corporation, New York, N.Y.

[21] Appl. No.: 885,766

[22] Filed: Mar. 13, 1978

[30] Foreign Application Priority Data

Mar. 31, 1977 [NL] Netherlands ..... 7703493

[51] Int. Cl.[2] ..... H05G 1/12

[52] U.S. Cl. ..... 361/56; 361/91; 361/111

[58] Field of Search ..... 361/56, 90, 91, 111; 315/125, 127, 91; 328/8; 250/401, 417, 418

[56] References Cited

U.S. PATENT DOCUMENTS

| | | | |
|---|---|---|---|
| 2,029,436 | 2/1936 | Morrison | 250/418 |
| 3,023,353 | 2/1962 | Currey | 361/91 X |
| 3,069,548 | 12/1962 | Bavor | 250/418 X |
| 3,230,459 | 1/1966 | Loya | 361/57 X |
| 3,588,510 | 6/1971 | Gager | 250/418 X |

FOREIGN PATENT DOCUMENTS

| | | | |
|---|---|---|---|
| 1513038 | 7/1969 | Fed. Rep. of Germany | 361/56 |
| 45-13797 | 5/1970 | Japan | 361/111 |

*Primary Examiner*—J. D. Miller
*Assistant Examiner*—L. Schroeder
*Attorney, Agent, or Firm*—Thomas A. Briody; William J. Streeter; Bernard Franzblau

[57] ABSTRACT

A device comprising an electron tube having two electrodes between which a potential difference generated by a high voltage generator exits. A protection circuit is connected between these electrodes to protect the device against excess voltages. The protection circuit consists of a series network of a capacitor having a capacitance which is substantially higher than the parasitic capacitance beween the electrodes and a number of diodes whose forward direction extends from the electrode of highest potential to the electrode of lowest potential.

12 Claims, 3 Drawing Figures

PROTECTIVE DEVICE FOR AN ELECTRON TUBE

The invention relates to a device comprising an electron tube having two electrodes connected to output terminals of a high voltage generator.

The high voltage generator of such a device comprises a high voltage transformer having a given internal impedance which is caused by copper losses (resistance) and stray inductance. Moreover, a given winding and wiring capacitance is present. In commonly used constructions, this results in a periodically damped RLC circuit in which oscillations are liable to occur. Oscillations of this kind notably occur when flash-over arises between the electrodes of the electron tube. Due to these oscillations, the voltage at the output terminals of the high voltage generator may temporarily become substantially higher so that parts of the device are liable to be damaged.

An object of the invention is to protect a device of the described kind in an inexpensive manner so that extremely high voltages due to oscillations can no longer occur.

To this end, the device in accordance with the invention is characterized in that both electrodes are also connected to a protection circuit which comprises a capacitor to which a number of diodes are connected in series, the arrangement being such that the forward direction of the diodes extends from the electrode of highest potential to that of the lowest potential, the capacitance of the capacitor being substantially higher than the parasitic capacitance occurring between the two electrodes.

Preferably, a resistor of at least a few MΩ is connected parallel to the diodes.

In order to distribute the voltage uniformly between the diodes, a preferred embodiment of the device in accordance with the invention is characterized in that the resistance is formed by a number of resistors which equals the number of diodes, each resistor being connected parallel to one of the diodes.

Figure 1:
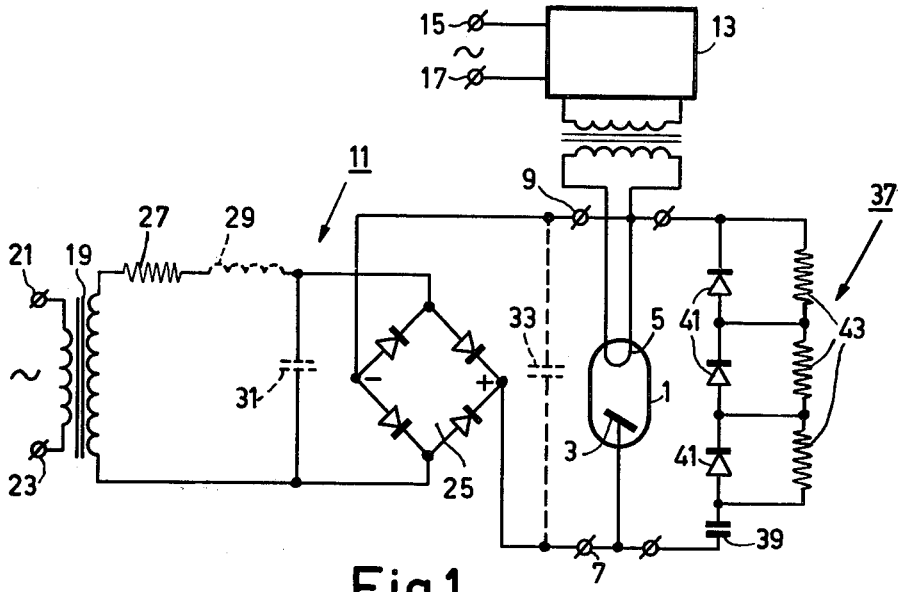
Figure 2A:
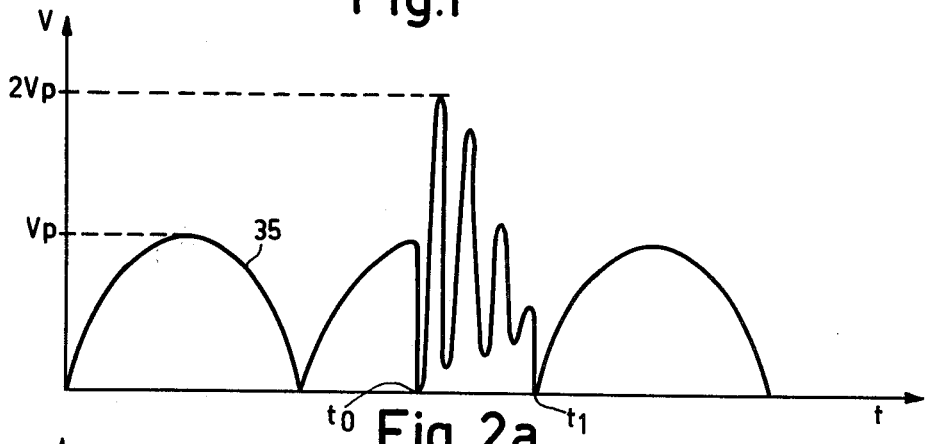
Figure 2B:
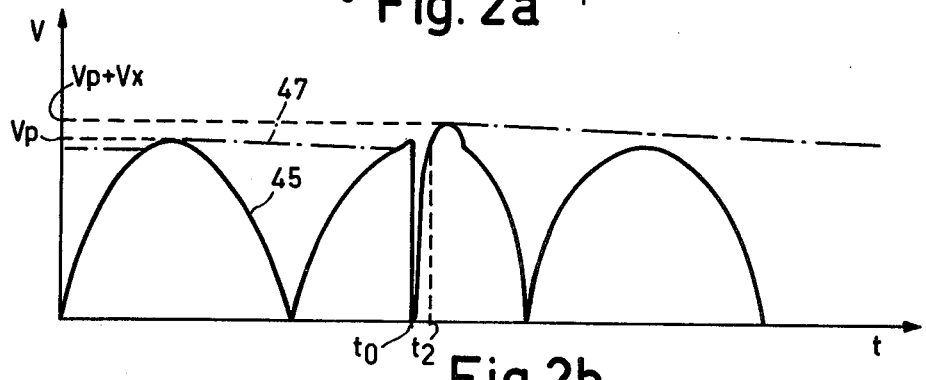

The invention will be described in detail hereinafter with reference to the accompanying drawing in which:

FIG. 1 shows a diagram of an embodiment of a device in accordance with the invention, and FIGS. 2*a* and 2*b* show voltage/time diagrams which to illustrate the improvement achieved by way of the invention.

The device shown in FIG. 1 comprises an X-ray tube 1 having an anode 3 and a cathode 5 which are connected to output terminals 7 and 9, respectively, of a high voltage generator 11. For the heating of the cathode 5, there is provided a variable filament current supply source 13, the input terminals 15, 17 of which are connected to the AC supply lines.

The high voltage generator 11 comprises a high voltage transformer 19, the primary side of which is connected to the AC supply via input terminals 21, 23. The secondary side is connected to the alternating voltage connections of a bridge rectifier 25, the direct voltage connections of which are connected to the output terminals 7,9 of the high voltage generator 11.

In addition to the described parts, the circuit comprises a number of parasitic elements which are denoted by broken lines. The transformer 19 has a copper resistance 27, a stray inductance 29, and a winding capacitance 31. Furthermore, between the anode 3 and the cathode 5 of the X-ray tube 1 there is a parasitic capacitance 33 which is mainly due to the connection leads between this tube and the high voltage generator 11. In the case of a high voltage generator for voltages of approximately 60 kV, the value R of the resistance 27 appears to amount to approximately 10 kΩ, while the value L of the inductance 29 amounts to approximately 100 mH. The parallel connected capacitances 31 and 33 together have a capacitance value $C_p$ of approximately 60 pF. This clearly illustrates that the circuit cannot be aperiodically damped because the requirement $R^2 > 4L/C_p$ is not satisfied. As a result, sudden voltage variations, caused by discharges in the X-ray tube 1, give rise to oscillations as shown in FIG. 2*a*. The curve 35 represents the variation of the voltage between the anode 3 and the cathode 5 as a function of the time. This is in principle a rectified sinusoidal voltage having a peak value $V_p$. At the instant $t_o$, a discharge occurs in the tube with the result that the voltage suddenly decreases to almost zero. As a result, oscillations occur in the circuit, it being possible for the voltage to temporarily increase to twice the peak value $2V_p$. It will be obvious that this may cause damage to parts of the circuit. The oscillations usually terminate only at the instant $t_1$ when the rectified sinusoidal voltage reaches the value zero. The substantially increased voltage during the oscillations itself may give rise to further flash-over in the tube so that the process actually intensifies itself.

In order to improve the situation, a protection circuit 37 is connected between the anode 3 and the cathode 5, said circuit consisting of a capacitor 39 to which a number (in this case three) of diodes 41 is connected in series. A resistor 43 is connected parallel to each of the diodes 41. The resistors 43 all have the same value and their series connection has a resistance of at least some MΩ, for example, 20 MΩ. The capacitance C of the capacitor 39 must be substantially higher than the overall parasitic capacitance $C_p$ between the electrodes, for example, one hundred times higher.

The operation of the protection circuit 37 will be described with reference to FIG. 2b. The non-interrupted curve 45 represents the voltage across the tube 1 and the stroke-dot curve 47 represents the voltage across the capacitor 39. During steady state operation, the voltage across the tube varies as shown in FIG. 2*a*. The capacitor is each time charged to a voltage $V_p$ and is subsequently discharged to a slightly lower value via the resistors 43. When a short-circuit or discharge occurs between the electrodes 3, 5 of the tube 1 (instant $t_o$), the tube voltage very quickly decreases to zero. The diodes 41 are then blocked due to the voltage across the capacitor 39 and the circuit starts to oscillate. The parasitic capacitances 31 and 33 are then charged and the inductance 29 takes up energy which reaches a maximum value $\frac{1}{2}LI^2$ at the instant $t_2$ (I is the current at this instant). If the oscillation were to continue in an undisturbed manner, as shown in FIG. 2*a*, this energy would be applied to the parasitic capacitances 31 and 33. Because the amplitude of the oscillation amounts to $V_p$, the energy in the order of $\frac{1}{2}LI^2$ becomes equal to $\frac{1}{2}C_pV_p^2$ in the parasitic capacitance.

The situation will be completely different due to the presence of the protection circuit. At the instant $t_2$, the diodes 41 become conductive so that the capacitance C of the capacitor 39 is connected parallel to the parasitic capacitance $C_p$. The amplitude $V_x$ of the oscillation is then determined by the equation:

$$\frac{1}{2}LI^2 = \frac{1}{2}C_pV_p^2 = \frac{1}{2}(C_p + C)\,V_x^2.$$

When C equals 100 $C_p$, therefore, $V_x$ is approximately 0.1 $V_p$.

Such a small overvoltage cannot damage the components of the circuit. The voltage across the capacitor 39 thus equals $V_p+V_x$ after flash-over. Thanks to the resistors 43, this capacitor is discharged to a value below $V_p$ again within a few periods. This discharge could also take place via the leakage resistance of the diodes 41, but the additional resistors 43 offer a further advantage in that they improve the voltage distribution between the diodes.

The described protection circuit utilizes inexpensive components and hence has no significant cost increasing effect for the device. It has been found that the types of diodes used for generating the high voltage in television receivers offer excellent results in this respect. The number of diodes to be used, obviously, is dependent on the voltage which can be withstood by the diodes and on the high voltage required by the tube 1.

What is claimed is:

1. A device comprising a high voltage generator having output terminals, an electron tube having two electrodes connected to said output terminals of the high voltage generator, means connecting said two electrodes to a protection circuit which comprises a capacitor and a number of diodes connected in series with the forward direction of the diodes extending from the tube electrode of highest potential to the tube electrode of lowest potential, a parasitic capacitance being present between said two electrodes, and the capacitance of the capacitor being chosen substantially higher than said parasitic capacitance occurring between the two electrodes.

2. A device as claimed in claim 1 further comprising a resistor of at least several megohms connected parallel to the diodes.

3. A device as claimed in claim 2 wherein the resistor comprises a number of resistors (41) which equals the number of diodes (41), each resistor being connected parallel to a respective one of the diodes.

4. A device as claimed in claim 1 wherein the electron tube comprises an X-ray tube.

5. A device as claimed in claim 3 wherein the electron tube comprises an X-ray tube.

6. A supply circuit for an electron tube comprising, an electron tube having two electrodes with a parasitic capacitance occurring therebetween, a high voltage generator having an internal inductance and a pair of output terminals respectively connected to said two electrodes, a protection circuit including a capacitor in series circuit with a plurality of diodes polarized in the same direction, means connecting said protection circuit to said two electrodes so that the anode ends of the diodes are closer to the electrode of higher potential and the cathode ends of the diodes are closer to the electrode of lower potential, the capacitance of the capacitor being substantially higher than said parasitic capacitance.

7. A supply circuit as claimed in claim 6 wherein the capacitance of the capacitor is approximately 100 times greater than said parasitic capacitance.

8. A supply circuit as claimed in claim 7 further comprising resistor means connected in parallel with said diodes.

9. A supply circuit as claimed in claim 8 wherein said resistor means includes a plurality of series connected resistors equal in number to the diodes with each resistor connected in parallel with a respective one of the diodes.

10. A supply circuit as claimed in claim 6 wherein the electron tube comprises an X-ray tube and the inductance of said high voltage generator includes a transformer having a primary winding for connection to a source of AC supply voltage and a secondary winding, said high voltage generator further comprising a diode rectifier circuit coupled between the transformer secondary winding and the output terminals of the high voltage generator for deriving a D.C. voltage at said output terminals.

11. A supply circuit as claimed in claim 10 wherein said protection circuit further comprises a plurality of series connected resistors equal in number to the diodes with each resistor connected in parallel with a respective one of the diodes.

12. A supply circuit as claimed in claim 6 wherein the parasitic capacitance and the internal inductance together form a resonant circuit and said protection circuit further comprises a plurality of series connected resistors equal in number to the diodes with each resistor connected in parallel with a respective one of the diodes.

* * * * *

UNITED STATES PATENT OFFICE

CERTIFICATE OF CORRECTION

Patent No. 4,190,873 Dated February 26,1980

Inventor(s) Frits H. Klokkers

It is certified that error appears in the above-identified patent and that said Letters Patent are hereby corrected as shown below:

In the Claims:

Col. 3, line 39, After "resistors" delete "(41)"

Col. 3, line 40, After "diodes" delete "(41)"

Signed and Sealed this

Ninth Day of June 1981

[SEAL]

Attest:

RENE D. TEGTMEYER

Attesting Officer

Acting Commissioner of Patents and Trademarks